US006345891B1

(12) United States Patent
Childers et al.

(10) Patent No.: US 6,345,891 B1
(45) **Date of Patent: *Feb. 12, 2002**

(54) METHOD AND APPARATUS FOR SPECIFYING INK VOLUME IN A MULTICHAMBER INK CONTAINER

(75) Inventors: Winthrop D. Childers, San Diego, CA (US); Ray A. Walker, Eugene, OR (US); Michael L. Bullock, San Diego, CA (US); Brian L. Helterline, Salem, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/629,120

(22) Filed: Jul. 31, 2000

(51) Int. Cl.[7] ..... B41J 2/175
(52) U.S. Cl. ..... 347/87; 347/19

(58) Field of Search ..... 347/7, 14, 19, 347/85, 86, 87

(56) References Cited

U.S. PATENT DOCUMENTS 5,049,898 A * 9/1991 Arthur et al. ..... 347/19
5,138,344 A * 8/1992 Ujita ..... 347/86
5,699,091 A * 12/1997 Bullock et al. ..... 347/19
6,089,687 A * 7/2000 Helterline ..... 347/7

* cited by examiner

*Primary Examiner*—Anh T. N. Vo
(74) *Attorney, Agent, or Firm*—Kevin B. Sullivan

(57) ABSTRACT

The present disclosure relates to an ink container for providing ink to an ink-jet printer. The ink container includes an electrical storage device for providing ink container parameters to the ink-jet printer. The electrical storage device contains a configuration parameter for specifying an ink container configuration and an ink volume parameter for specifying an ink volume for the ink container.

17 Claims, 13 Drawing Sheets

METHOD AND APPARATUS FOR SPECIFYING INK VOLUME IN A MULTICHAMBER INK CONTAINER

BACKGROUND OF THE INVENTION

The present invention relates to ink-jet printing systems that make use of a replaceable printing component. More particularly, the present invention relates to replaceable printing components that include an electrical storage device for providing information to the ink-jet printing system.

Ink-jet printers frequently make use of an ink-jet printhead mounted within a carriage that is moved back and forth across a print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system to not move with the carriage. For the case where the ink supply is not carried with the carriage, the ink supply can be intermittently or continuously connected to the printhead for replenishing the printhead. In either case, the replaceable printing components, such as the ink container and the printhead, require periodic replacement. The ink supply is replaced when exhausted. The printhead is replaced at the end of printhead life.

It is frequently desirable to alter printer parameters concurrently with the replacement of printer components such as discussed in U.S. patent application Ser. No. 08/584,499 entitled "Replaceable Part With Integral Memory For Usage, Calibration And Other Data" assigned to the assignee of the present invention. U.S. patent application Ser. No. 08/584,499 discloses the use of a memory device, which contains parameters relating to the replaceable part. The installation of the replaceable part allows the printer to access the replaceable part parameters to insure high print quality. By incorporating the memory device into the replaceable part and storing replaceable part parameters in the memory device within the replaceable component the printing system can determine these parameters upon installation into the printing system. This automatic updating of printer parameters frees the user from having to update printer parameters each time a replaceable component is newly installed. Automatically updating printer parameters with replaceable component parameters insures high print quality. In addition, this automatic parameter updating tends to ensure the printer is not inadvertently damaged due to improper operation, such as, operating after the supply of ink is exhausted or operation with the wrong or non-compatible printer components.

For the case where the printing system is capable of accommodating a plurality of different ink container sizes or types it is important that size or type information is transferred between the printer and the ink container in a highly reliable and efficient manner. This exchange of information should not require the intervention of the user thereby ensuring greater ease of use and greater reliability. Furthermore, it is important that the integrity of the information be preserved. Finally, the ink container should have relatively low manufacturing costs to allow low per page printing costs.

SUMMARY OF THE INVENTION

One aspect of the present invention is an ink container for providing ink to an ink-jet printer. The ink container includes an electrical storage device for providing ink container parameters to the ink-jet printer. The electrical storage device contains a configuration parameter for specifying an ink container configuration and an ink volume parameter for specifying an ink volume for the ink container.

Another aspect of the present invention is the ink volume parameter is an ink scale parameter for selecting an ink volume range from a plurality of ink volume ranges and a fill proportion parameter for specifying a fill proportion for the selected ink volume range associated with the supply of ink in the reservoir.

Yet another aspect of the present invention is the electrical storage device contains a plurality of ink volume parameters with each of the ink volume parameters corresponding to an ink volume associated with an ink chamber of a plurality of ink chambers within the ink container.

DETAILED DESCRIPTION OF THE PREFERRED EMBODIMENT

Figure 1:
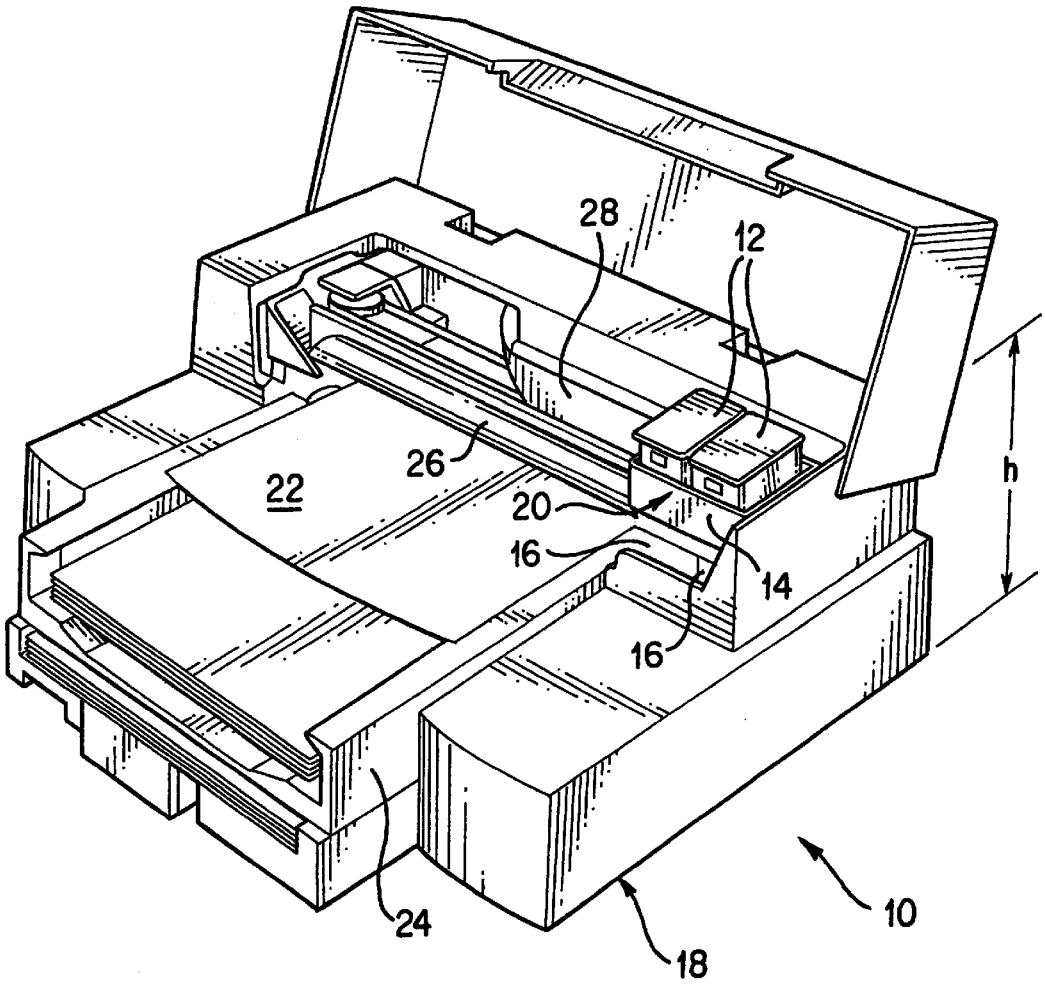
FIG. 1 is one exemplary embodiment of an ink jet printing system of the present invention shown with a cover opened to show a plurality of replaceable ink containers of the present invention.

FIG. 1 is a perspective view of one exemplary embodiment of a printing system 10 shown with its cover open, that includes at least one replaceable ink container 12 containing a plurality of different ink types that is installed in a receiving station 14. With the replaceable ink container 12 properly installed into the receiving portion 14, the plurality of different inks are provided from the replaceable ink container 12 to at least one inkjet printhead 16. The inkjet printhead 16 is responsive to activation signals from a printer portion 18 to deposit ink on print media. As ink is ejected from the printhead 16, the printhead 16 is replenished with ink from the ink container 12.

In one preferred embodiment the replaceable ink container 12, receiving station 14, and inkjet printhead 16 are each part of a scanning carriage that is moved relative to a print media 22 to accomplish printing. The printer portion 18 includes a media tray 24 for receiving the print media 22. As the print media 22 is stepped through a print zone, the scanning carriage 20 moves the printhead 16 relative to the print media 22. The printer portion 18 selectively activates the printhead 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

The ink-jet printing system 10 shown in FIG. 1 is configured to receive ink containers 12 having different ink volumes or different configurations. Ink containers having different volumes is accomplished using several methods, such as, the use of ink containers 12 that are different sizes with each size having a different volume associated therewith. Another technique for providing different ink volumes is to use ink containers 12 of the same size, but vary a volume of ink in each of the ink containers. Some examples of different ink container 12 configurations include a single chamber arrangement containing one ink type or color or a multiple chamber arrangement containing multiple ink types or colors. It is critical that the ink container 12 provides a volume of ink that matches a proper use model for the particular application. Because ink jet inks typically have a limited storage life once inserted into the printer it is important that the ink container be sized sufficiently large to prevent inconveniencing the user with frequent ink container changes and sufficiently small to prevent ink from becoming stale with age. When ink-jet inks have exceeded the storage life and have become stale these inks cannot reliably produce high quality output images.

One aspect of the present invention is a method and apparatus for storing information on the replaceable ink containers 12 for updating operation parameters of the printer portion 10. An electrical storage device is associated with each of the replaceable ink containers 12. The electrical storage device contains information related to the particular replaceable ink container 12. Installation of the replaceable ink container 12 into the printer portion 10 allows information to be transferred between the electrical storage device and the printer portion 18 to insure high print quality as well as to prevent the installation of non-compatible replaceable ink container 12. The information provided to the printing system 10 includes, among other information, information specifying ink volume and configuration of the replaceable ink container 12. The information provided from the replaceable ink container 12 to the printing portion 18 tends to prevent operation of the printing system 10 in a manner which damages the printing system 10 or which reduces the print quality.

Although the printing system 10 shown in FIG. 1 makes use of ink containers 12 which are mounted on the scanning carriage 20, the present invention is equally well suited for other types of printing system configurations. One such configuration is one where the replaceable ink containers 12 are mounted off the scanning carriage 20. Alternatively, the printhead 16 and the ink container 12 may be incorporated into an integrated printing cartridge that is mounted to the scanning carriage 20. Finally, the printing system 10 may be used in a wide variety of applications such as facsimile machines, postal franking machines, textile printing devices and large format type printing systems suitable for use in displays and outdoor signage.

Figure 2:
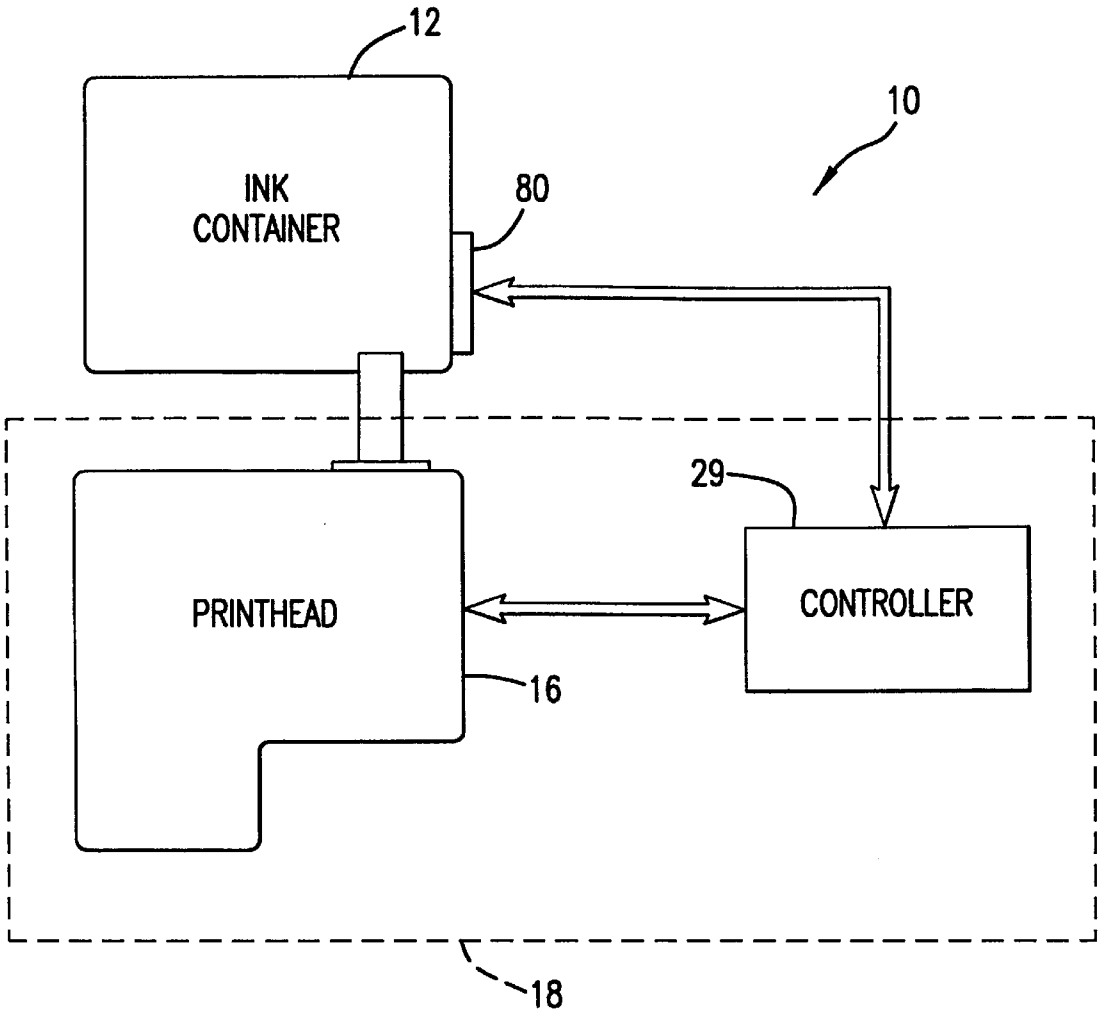
FIG. 2 is a schematic representation of the inkjet printing system shown in FIG. 1.

FIG. 2 is a simplified schematic representation of the inkjet printing system 10 of the present invention shown in FIG. 1. FIG. 2 is simplified to illustrate a single printhead 16 connected to a single ink container 12.

The inkjet printing system 10 of the present invention includes the printer portion 18 and the ink container 12, which is configured to be received by the printer portion 18. The printer portion 18 includes the inkjet printhead 16 and a controller 29. With the ink container 12 properly inserted into the printer portion 18, an electrical and fluidic coupling is established between the ink container 12 and the printer portion 18. The fluidic coupling allows ink stored within the ink container 12 to be provided to the printhead 16. The electrical coupling allows information to be passed between an electrical storage device 80 disposed on the ink container 12 and the printer portion 18. The exchange of information between the ink container 12 and the printer portion 18 is to ensure the operation of the printer portion 18 is compatible with the ink contained within the replaceable ink container 12 thereby achieving high print quality and reliable operation of the printing system 10.

The controller 29, among other things, controls the transfer of information between the printer portion 18 and the replaceable ink container 12. In addition, the controller 29 controls the transfer of information between the printhead 16 and the controller 29 for activating the printhead to selectively deposit ink on print media. In addition, the controller 29 controls the relative movement of the printhead 16 and print media. The controller 29 performs additional functions such as controlling the transfer of information between the printing system 10 and a host device such as a host computer (not shown).

In order to ensure the printing system 10 provides high quality images on print media, it is necessary that the operation of the controller 29 account for the particular replaceable ink container 12 installed within the printer portion 18. The controller 29 utilizes the parameters that are provided by the electrical storage device 80 to account for the particular replaceable ink container 12 installed in the printer portion 18 to ensure reliable operation and ensure high quality print images.

Among the parameters, for example, that can be stored in the electrical storage device 80 associated with the replaceable ink container 12 is information specifying an initial ink volume, a current ink volume and ink container 12 configuration information, just to name a few. The particular information stored on the electrical storage device 80 will be discussed in more detail later.

Figure 3:
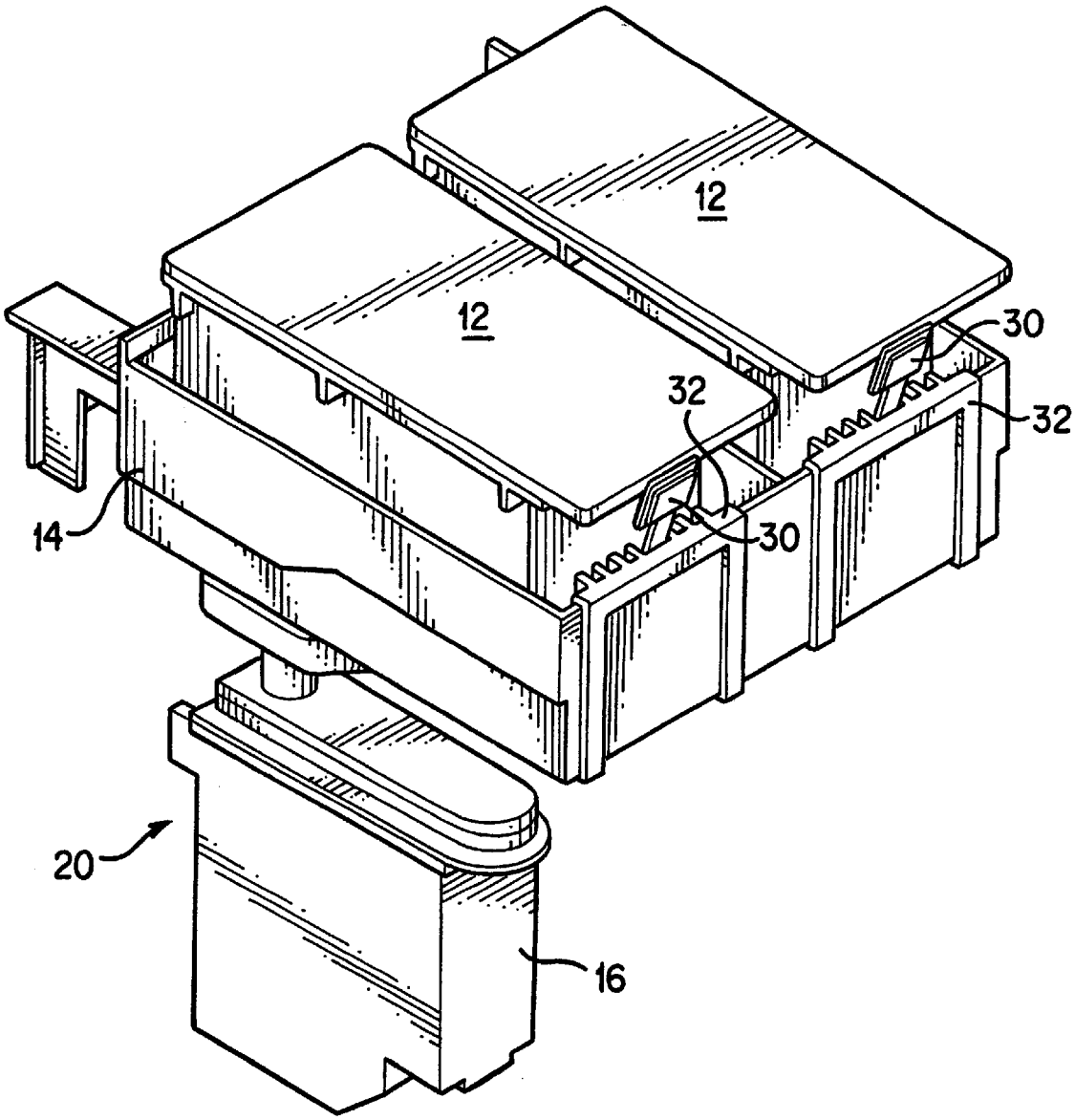
FIG. 3 is a greatly enlarged perspective view of a portion of a scanning carriage showing the replaceable ink containers of the present invention positioned in a receiving station that provides fluid communication between the replaceable ink containers and one or more printhead.

FIG. 3 is a perspective view of a portion of the scanning carriage 20 showing a pair of replaceable ink containers 12 properly installed in the receiving station 14. An inkjet printhead 16 is in fluid communication with the receiving station 14. In the preferred embodiment, the inkjet printing system 10 shown in FIG. 1 includes a tri-color ink container containing three separate ink colors and a second ink container containing a single ink color. In this preferred embodiment, the tri-color ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

The scanning carriage portion 20 shown in FIG. 3 is shown fluidically coupled to a single printhead 16 for simplicity. In the preferred embodiment, four inkjet printheads 16 are each fluidically coupled to the receiving station 14. In this preferred embodiment, each of the four printheads are fluidically coupled to each of the four colored inks contained in the replaceable ink containers. Thus, the cyan, magenta, yellow and black printheads 16 are each coupled to their corresponding cyan, magenta, yellow and black ink supplies, respectively. Other configurations which make use of fewer printheads than four are also possible. For example, the printhead 16 can be configured to print more than one ink color by properly partitioning the printhead 16 to allow a first ink color to be provided to a first group of ink nozzles and a second ink color to be provided to a second group of ink nozzles, with the second group of ink nozzles different from the first group. In this manner, a single printhead 16 can be used to print more than one ink color allowing fewer than four printheads 16 to accomplish four-color printing. The fluidic path between each of the replaceable ink containers 12 and the printhead 16 will be discussed in more detail with respect to FIG. 4.

Each of the replaceable ink containers 12 include a latch 30 for securing the replaceable ink container 12 to the receiving station 14. The receiving station 14 in the preferred embodiment includes a set of keys 32 that interact with corresponding keying features (not shown) on the replaceable ink container 12. The keying features on the replaceable ink container 12 interact with the keys 32 on the receiving station 14 to ensure that the replaceable ink container 12 is compatible with the receiving station 14.

Figure 4:
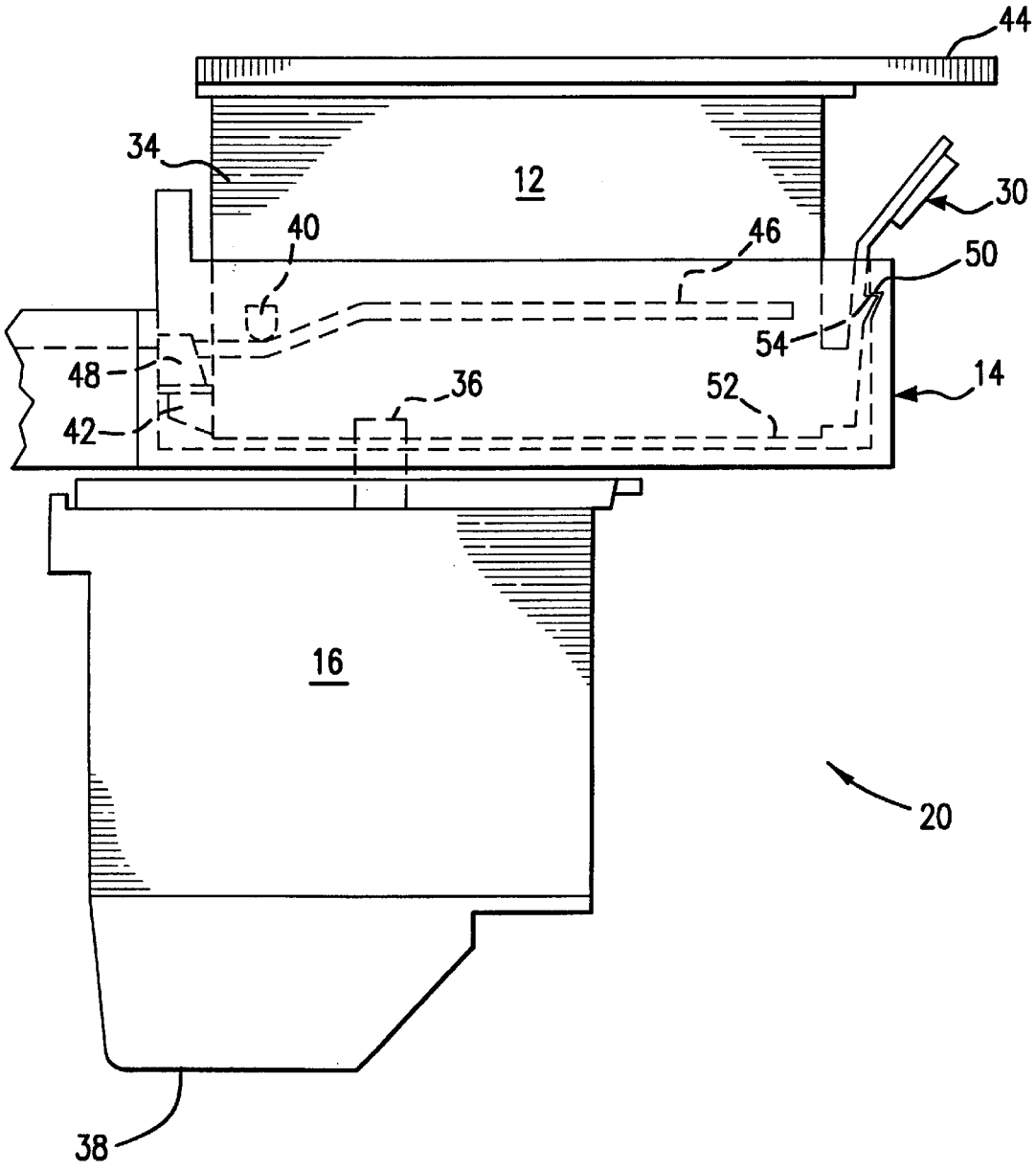
FIG. 4 is a side plan view of a portion of the scanning carriage showing guiding and latching features associated with each of the replaceable ink container and the receiving station for securing the replaceable ink container, thereby allowing fluid communication with the printhead.

FIG. 4 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the printhead 16.

The replaceable ink container 12 includes a reservoir portion 34 for containing one or more quantities of ink. In the preferred embodiment, the tri-color replaceable ink container 12 has three separate ink containment reservoirs, each containing ink of a different color. In this preferred embodiment, the monochrome replaceable ink container 12 is a single ink reservoir 34 for containing ink of a single color.

In the preferred embodiment, the reservoir 34 has a capillary storage member (not shown) disposed therein. The capillary storage member is a porous member having sufficient capillarity to retain ink to prevent ink leakage from the reservoir 34 during insertion and removal of the ink container 12 from the printing system 10. This capillary force must be sufficiently great to prevent ink leakage from the ink reservoir 34 over a wide variety of environmental conditions such as temperature and pressure changes. In addition, the capillarity of the capillary member is sufficient to retain ink within the ink reservoir 34 for all orientations of the ink reservoir as well as a reasonable amount of shock and vibration the ink container may experience during normal handling. The preferred capillary storage member is a network of heat bonded polymer fibers described in U.S. patent application entitled "Ink Reservoir for an Inkjet Printer" filed on Oct. 29, 1999, Ser. No. 09/430,400, assigned to the assignee of the present invention and incorporated herein by reference.

Once the ink container 12 is properly installed into the receiving station 14, the ink container 12 is fluidically coupled to the printhead 16 by way of fluid interconnect 36. Upon activation of the printhead 16, ink is ejected from the ejection portion 38 producing a negative gauge pressure, sometimes referred to as backpressure, within the printhead 16. This negative gauge pressure within the printhead 16 is sufficient to overcome the capillary force resulting from the capillary member disposed within the ink reservoir 34. Ink is drawn by this backpressure from the replaceable ink container 12 to the printhead 16. In this manner, the printhead 16 is replenished with ink provided by the replaceable ink container 12.

The fluid interconnect 36 is preferably an upstanding ink pipe that extends upwardly into the ink container 12 and downwardly to the inkjet printhead 16. The fluid interconnect 36 is shown greatly simplified in FIG. 4. In the preferred embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16.

The replaceable ink container 12 further includes a guide feature 40, an engagement feature 42, a handle 44 and a latch feature 30 that allow the ink container 12 to be inserted into the receiving station 14 to achieve reliable fluid interconnection with the printhead 16 as well as form reliable electrical interconnection between the replaceable ink container 12 and the scanning carriage 20.

The receiving station 14 includes a guide rail 46, an engagement feature 48 and a latch engagement feature 50. The guide rail 46 cooperates with the guide rail engagement feature 40 and the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 52 associated with the receiving station 14 until a latch engagement feature 50 associated with the receiving station 14 engages a hook feature 54 associated with the latch member 30 to secure a back end or trailing end of the ink container 12 to the receiving station 14. It is the cooperation of the features on the ink container 12 with the features associated with the receiving station 14 that allow proper insertion and functional interfacing between the replaceable ink container 12 and the receiving station 14. The receiving station 14 will now be discussed in more detail with respect to FIG. 5.

Figure 5:
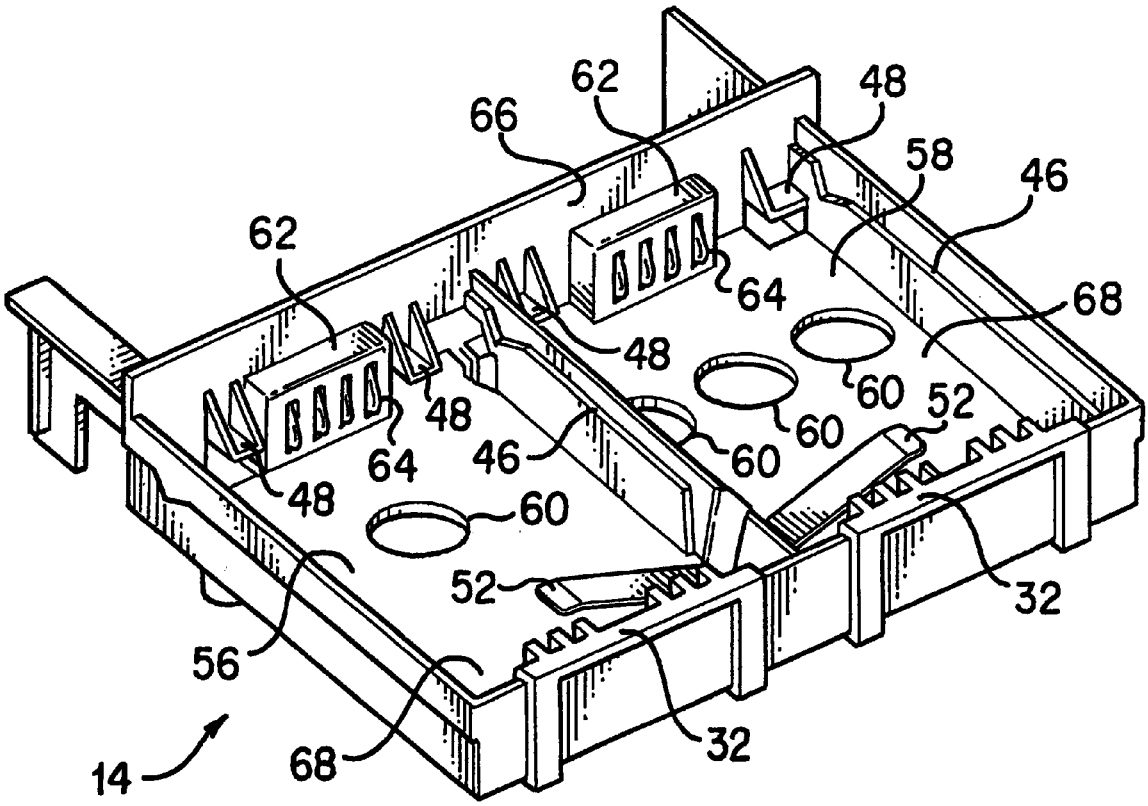
FIG. 5 is a receiving station shown in isolation for receiving one or more replaceable ink containers of the present invention.

FIG. 5 is a front perspective view of the ink container receiving station 14 shown in isolation. The receiving station 14 shown in FIG. 5 includes a monochrome bay 56 for receiving an ink container 12 containing a single ink color and a tri-color bay 58 for receiving an ink container having three separate ink colors contained therein. In this preferred embodiment, the monochrome bay 56 receives a replaceable ink container 12 containing black ink, and the tri-color bay receives a replaceable ink container containing cyan, magenta, and yellow inks, each partitioned into a separate reservoir within the ink container 12. The receiving station 14 as well as the replaceable ink container 12 can have other arrangements of bays 56 and 58 for receiving ink containers containing different numbers of distinct inks contained therein. In addition, the number of receiving bays 56 and 58 for the receiving station 14 can be other than two. For example, a receiving station 14 can have four separate bays for receiving four separate monochrome ink containers 12 with each ink container containing a separate ink color to accomplish four-color printing.

Each bay 56 and 58 of the receiving station 14 includes an aperture 60 for receiving each of the upright fluid interconnects 36 that extends therethrough. The fluid interconnect 36 is a fluid inlet for ink to exit a corresponding fluid outlet associated with the ink container 12. An electrical interconnect 62 is also included in each receiving bay 56 and 58. The electrical interconnect 62 includes a plurality of electrical contacts 64. In the preferred embodiment, the electrical contacts 64 are an arrangement of four spring-loaded electrical contacts. With proper installation of the replaceable ink container 12 into the corresponding bay of the receiving station 14, proper engagement with each of the electrical connectors 62 and fluid interconnects 36 is established in a reliable manner.

The guide rails 46 disposed on either side of the fluid interconnects within each bay 56 and 58 engage the corresponding guide feature 40 on either side of the ink container 12 to guide the ink container into the receiving station. When the ink container 12 is fully inserted into the receiving station 14, the engagement features 48 disposed on a back wall 66 of the receiving station 14 engage the corresponding engagement features 42 shown in FIG. 3 on the ink container 12. The engagement features 48 are disposed on either side of the electrical interconnect 62. A biasing means 52 such as a leaf spring is disposed within the receiving station 14. The leaf spring 52 provides a biasing force that tends to urge the ink container 12 upward from a bottom surface 68 of the receiving station 14. The leaf spring aids in the latching of the ink container 12 to the receiving station 14 as well as aiding the removal of the ink container 12 from the receiving station.

Figure 6A:
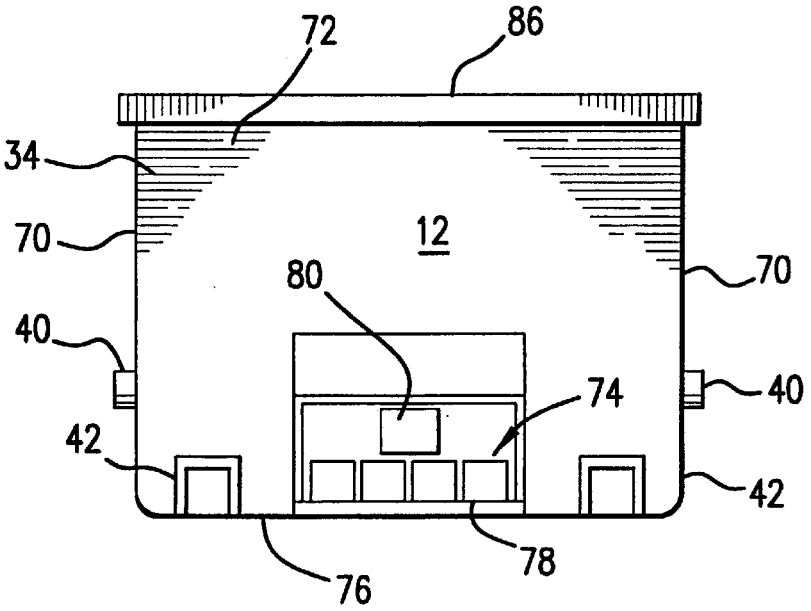
FIGS. 6*a,* 6*b,* 6*c,* and 6*d* are isometric views of a three-color replaceable ink container of the present invention shown in isolation.
Figure 6B:
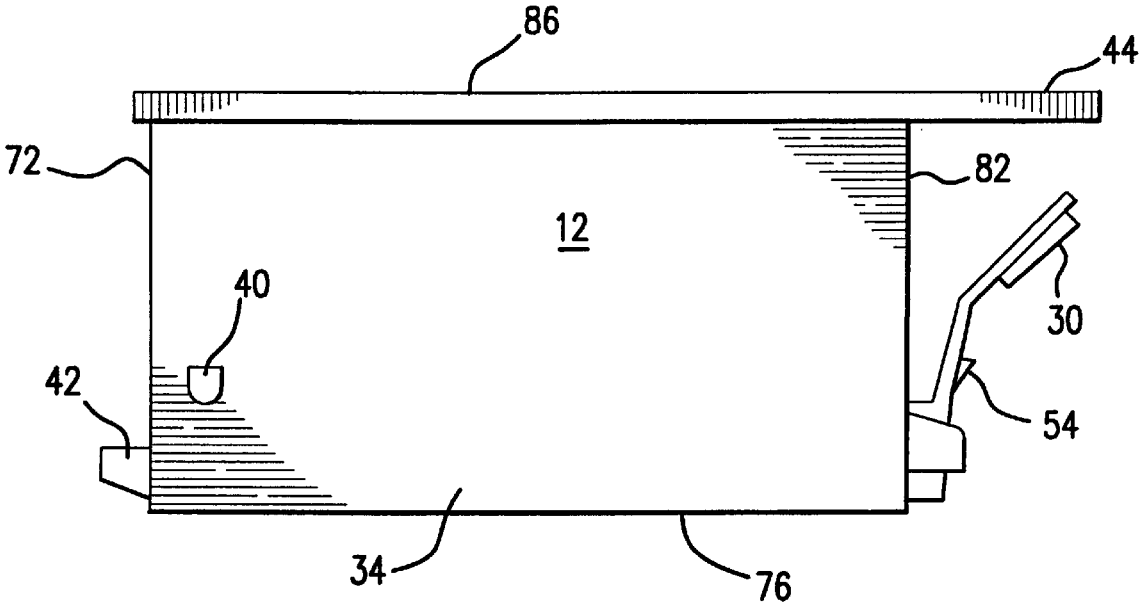

FIGS. 6*a,* 6*b,* 6*c,* and 6*d* show front plan, side plan, back plan, and bottom plan views, respectively, of the replaceable ink container 12 of the present invention. As shown in FIG. 6*a,* the replaceable ink container 12 includes a pair of outwardly projecting guide rail engagement features 40. In the preferred embodiment, each of these guide rail engagement features 40 extends outwardly in a direction orthogonal to upright side 70 of the replaceable ink container 12. The engagement features 42 extend outwardly from a front surface or leading edge 72 of the ink container 12. The engagement features 42 are disposed on either side of an electrical interface 74 and are disposed toward a bottom surface 76 of the replaceable ink container 12. The electrical interface 74 includes a plurality of electrical contacts 78, with each of the electrical contacts 78 electrically connected to an electrical storage device 80.

Figure 6C:
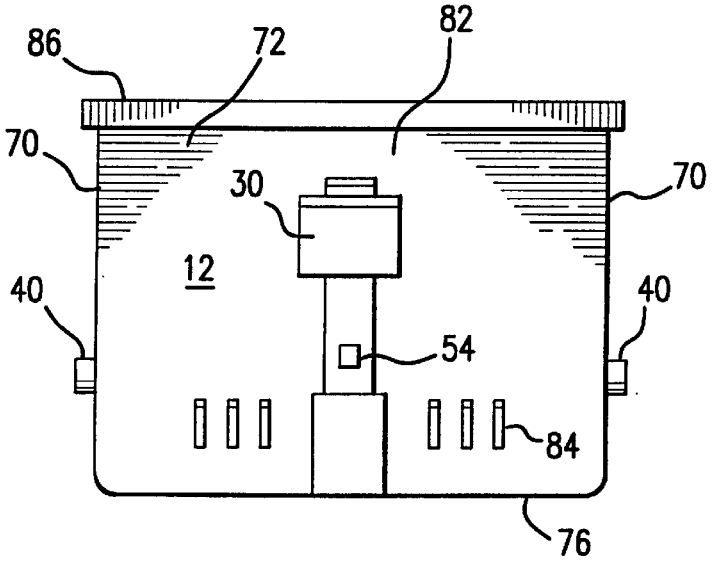
Figure 6D:
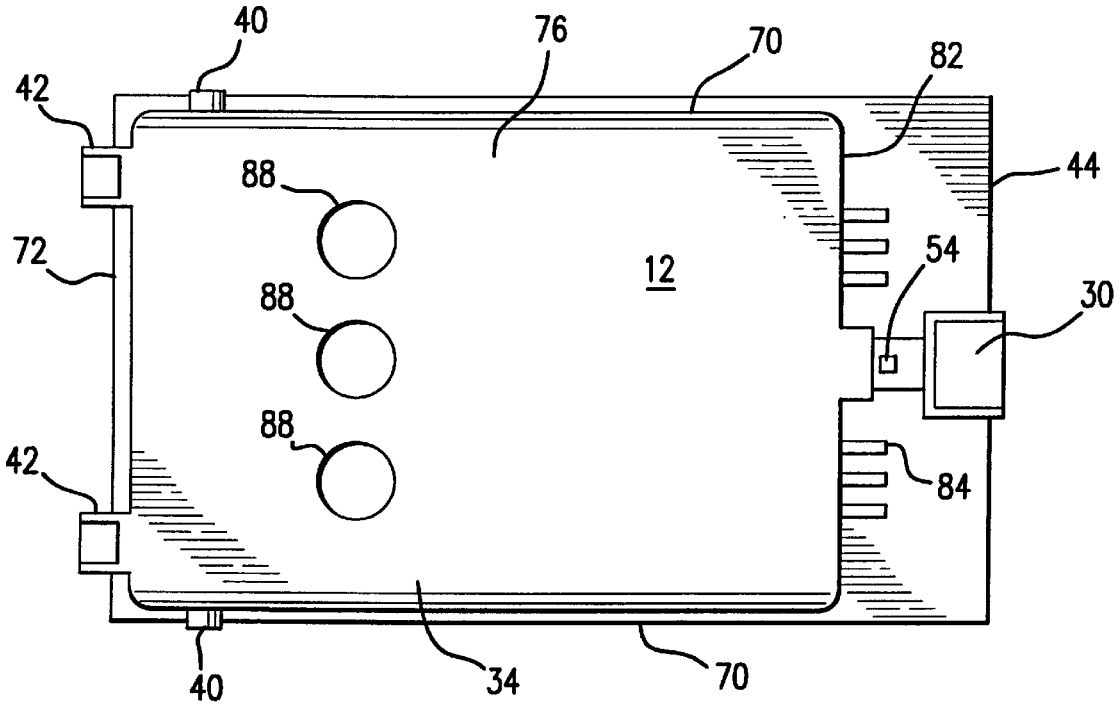

Opposite the leading end 72 is a trailing end 82 shown in FIG. 6*c*. The trailing end 82 of the replaceable ink container 12 includes the latch feature 30 having an engagement hook 54. The latch feature 30 is formed of a resilient material which allows the latch feature to extend outwardly from the trailing end thereby extending the engagement feature outwardly toward the corresponding engagement feature associated with the receiving station 14. As the latch member 30 is compressed inwardly toward the trailing end 82, the latch member exerts a biasing force outwardly in order to ensure the engagement feature 54 remains in engagement with the corresponding engagement feature 50 associated with the receiving station 14 to secure the ink container 12 into the receiving station 14.

The replaceable ink container 12 also includes keys 84 disposed on the trailing end of the replaceable ink container 12. The keys are preferably disposed on either side of the latch 30 toward the bottom surface 76 of the replaceable ink container 12. The keys 84, together with keying features 32 on the receiving station 14, interact to ensure the ink container 12 is inserted in the correct bay 56 and 58 in the receiving station 14. In addition, the keys 84 and the keying features 32 ensure that the replaceable ink container 12 contains ink that is compatible both in color and in chemistry or compatibility with the corresponding receiving bay 56 and 58 within the receiving station 14.

The handle portion 44 is disposed on a top surface 86 at the trailing edge 82 of the replaceable ink container 12. The handle portion 44 allows the ink container 12 to be grasped at the trailing edge 82 while inserted into the appropriate bay of the receiving station 14. Positioning the handle portion above apertures 88 tends to reduce the opportunity for the customer to get ink on their hands while inserting the ink container 12 into the receiving station 14. In addition, the handle portion 44 is disposed on the reservoir 34 opposite the electrical contacts 78 to reduce or eliminate handling of the electrical contacts 78 during insertion of the ink container 12 into the receiving station 14. This handling can contaminate the electrical contacts. Contamination of the electrical contacts with salts and oils frequently found in human skin can result in an unreliable or high resistance electrical connection between the ink container 12 and the printer portion 18.

The ink container 12 includes apertures 88 disposed on the bottom surface 76 of the replaceable ink container 12. The apertures 88 allow the fluid interconnect 36 to extend through the reservoir 34 to engage the capillary member disposed therein. In the case of the tri-color replaceable ink container 12, there are three fluid outlets 88, with each fluid outlet corresponding to a different ink color. In the case of the tri-color chamber, each of three fluid interconnects 36 extend into each of the fluid outlets 88 to provide fluid communication between each ink chamber and the corresponding print head for that ink color.

Figure 7:
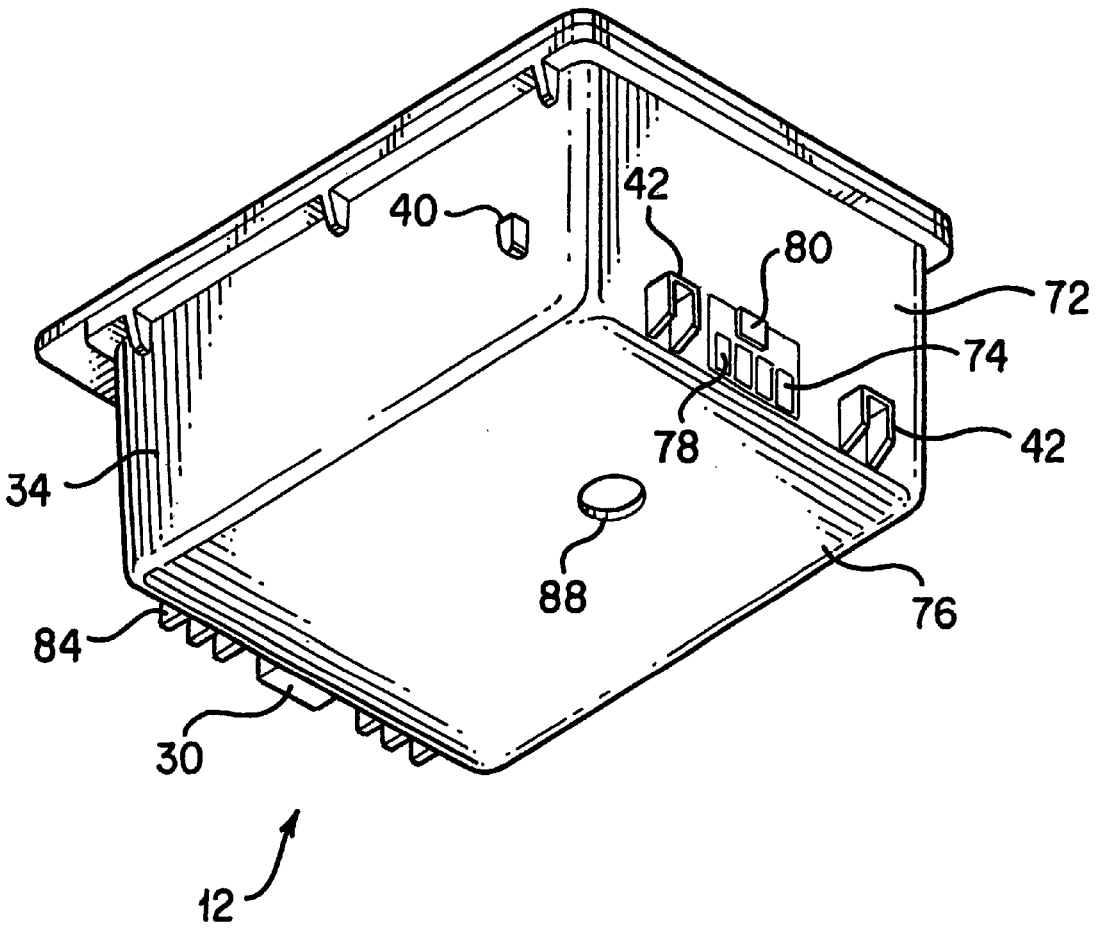
FIG. 7 is a perspective view of a single color replaceable ink container of the present invention.

FIG. 7 is a perspective view of a monochrome ink container positioned for insertion into the monochrome bay 56 in the receiving station 14 shown in FIG. 5. The monochrome ink container shown in FIG. 7 is similar to the tri-color ink container shown in FIGS. 6*a* through 6*d* except that only a single fluid outlet 88 is provided in the bottom surface 76. The monochrome replaceable ink container 12 contains a single ink color and therefore receives only a single corresponding fluid interconnect 36 for providing ink from the ink container 12 to the corresponding printhead.

Figure 8:
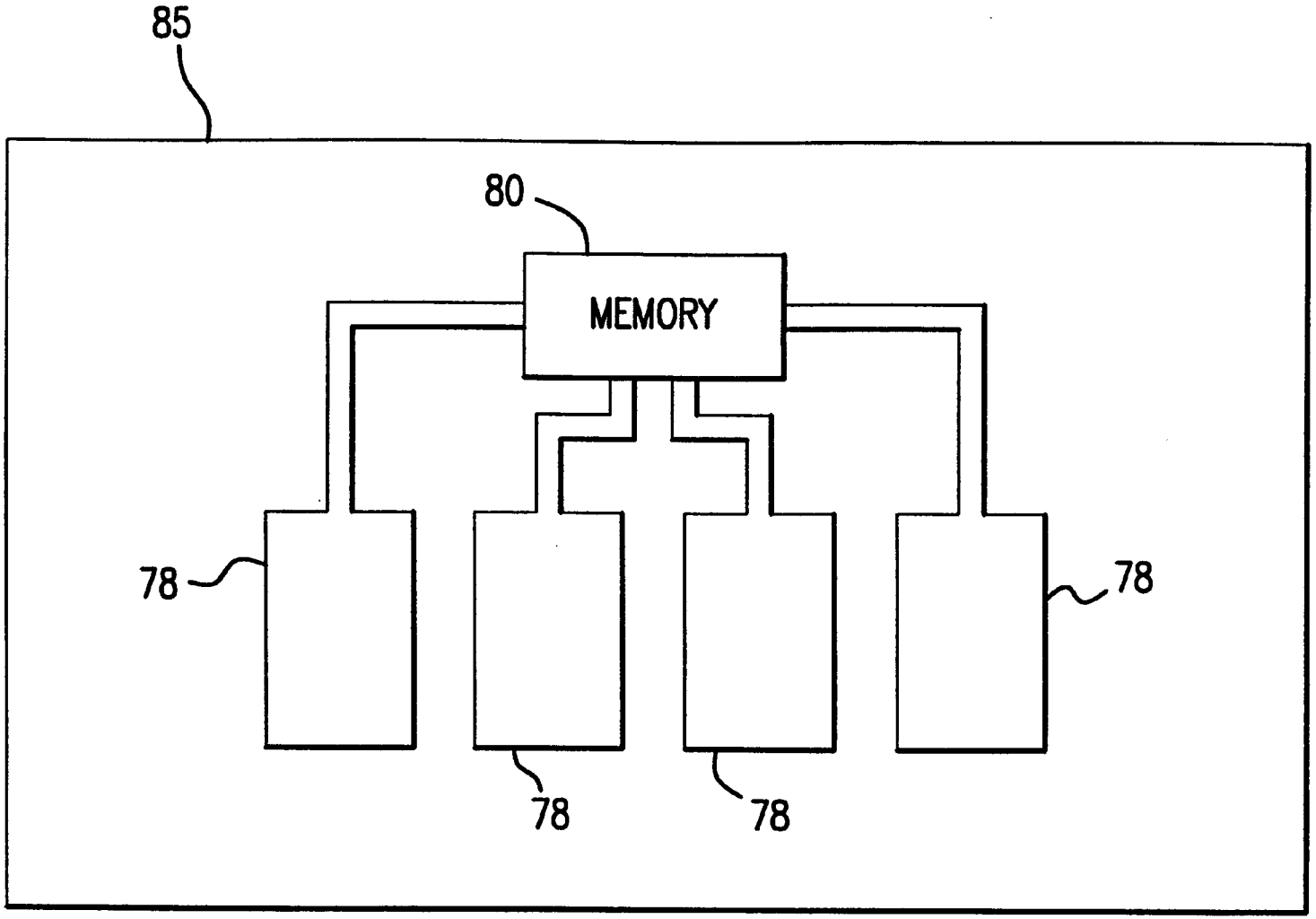
FIG. 8 is a top plan view of an electrical storage device that is electrically connected to a plurality of electrical contacts.

FIG. 8 is a greatly enlarged view of the electrical storage device 80 and electrical contacts 78. In one preferred embodiment, the electrical storage device 80 and the electrical contacts are mounted on a substrate 85. Each of the electrical contacts 78 is electrically connected to the electrical storage device 80. Each of the electrical contacts 78 is electrically isolated from each other by the substrate 85. In one preferred embodiment, the electrical storage device 80 is a semiconductor memory that is mounted to the substrate 85. In the preferred embodiment, the substrate 85 is adhesively bonded to the ink container 12.

In one preferred embodiment, there are four electrical contacts 78 representing contacts for power and ground connections as well as clock and data connections. Insertion of the replaceable ink container 12 into the printing portion 18 establishes electrical connection between the electrical contacts 64 on the receiving station 14 and the electrical contacts 78 on the replaceable ink container 12. With power and ground applied to the electrical storage device 80, data is transferred between the printing portion 18 and the replaceable ink container 12 at a rate established by the clock signal. It is critical that electrical connection between the printer portion 18 and the replaceable ink container 12 formed by electrical contacts 64 and 78, respectively, be low resistance connections to ensure reliable data transfer. If the electrical contacts 64 and 78 fail to provide a low resistance connection, then data may not be properly transferred, or the data may be corrupted or inaccurate. Therefore, it is critical that reliable, low resistance connection is made between the ink container 12 and the printing portion 18 to ensure proper operation of the printing system 10.

Figure 9:
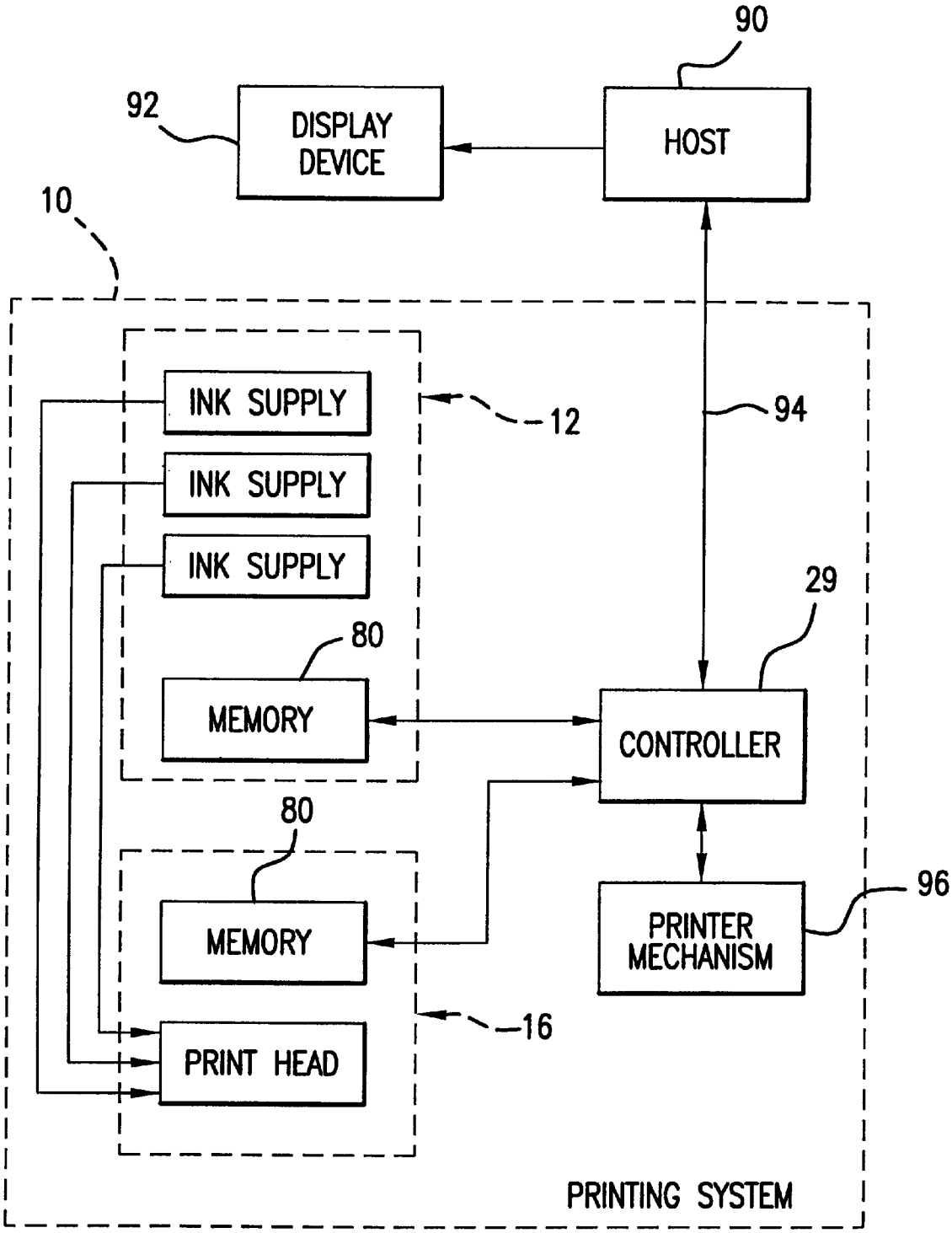
FIG. 9 depicts a schematic block diagram of the ink-jet printing system of FIG. 1 shown connected to a host and which includes the replaceable ink container and printhead each of which contain the electrical storage device.

FIG. 9 represents a block diagram of the printing system 10 of the present invention shown connected to an information source or host computer 90. The host computer 90 is shown connected to a display device 92. The host 90 can be a variety of information sources such as a personal computer, work station, or server to name a few, that provides image information to the controller 29 by way of a data link 94. The date link 94 may be any one of a variety of conventional data lines such as an electrical link or an infrared link for transferring information between the host 90 and the printing system 10.

The ink container 12 shown in FIG. 9 includes the electrical storage device 80 and three separate ink supplies representing the tri-color ink container 12 shown in FIGS. 6*a*–6*d*. When properly inserted into the tri-color receiving bay 58 fluid communication is established between each of the separate in supplies or chambers and one or more inkjet printheads 16.

The controller 29 is electrically connected to the electrical storage devices 80 associated with each of the printhead 16 and the ink container 12. In addition, the controller 29 is electrically connected to a printer mechanism 96 for controlling media transport and movement of the carriage 20. The controller 29 makes use of parameters and information provided by the host 90, the memory 80 associated with the ink container 12 and memory 80 associated with the printhead 16 to accomplish printing.

The host computer 90 provides image description information or image data to the printing system 10 for forming images on print media. In addition, the host computer 90 provides various parameters for controlling operation of the printing system 10, which is typically resident in printer control software typically referred to as the "print driver". In order to ensure the printing system 10 provides the highest quality images it is necessary that the operation of the controller 29 compensate for the particular replaceable ink container 12 installed within the printing system 10. It is the electric storage device 80 that is associated with each replaceable ink container 12 that provides parameters particular to the replaceable ink container 12 that allows the controller 29 to utilize these parameters to ensure the reliable operation of the printing system 10 and insure high quality print images.

The technique of the present invention allows ink volume information for each of the ink chambers or ink supplies contained within the ink container 12 to be passed between the ink container 12 and the controller 29 in an efficient and reliable manner. It is frequently desirable to pass very accurate ink volume information between the replaceable ink container 12 and the controller 29. For example, for the ink container 12 it is necessary to have accurate ink volume information associated with the ink container 12 passed to the controller 29 when the ink container 12 is initially inserted into the printing system 10. This information is used by the printing system 10 to compute remaining ink in the ink container 12 based on ink usage. Therefore, it is critical that very accurate ink volume information be associated with the ink container 12 and that this information is accurately provided to the controller 29. The controller 29 uses this ink volume information as a basis for determining an out-of-ink condition. It is important that this out-of-ink condition be determined accurately such that the printer is not operated without ink. Operation of the printer without ink can cause reliability problems or, of long enough, produce catastrophic failure.

The technique of the present invention must not only be capable of providing accurate ink volume information but also capable of providing accurate ink volume information over a large ink volume range. The ink volume range varies with the particular printing application. For example, large format printing requires ink containers that are typically several liters in size as a convenience to the user. Significantly smaller ink containers would require greater frequency of ink container replacement which if frequent enough can be an inconvenience to the user.

In the case of a desktop printer application for home use the ink container 12 may contain a significantly lower volume of ink in the order of 100 cubic centimeters (cc's) or less. Ink containers of larger volume for this application would likely result in exceeding its shelf life or storage period thereby resulting in reduced print quality. In addition, ink use rate for a given application depends on the particular usage for the individual user.

Figure 10:
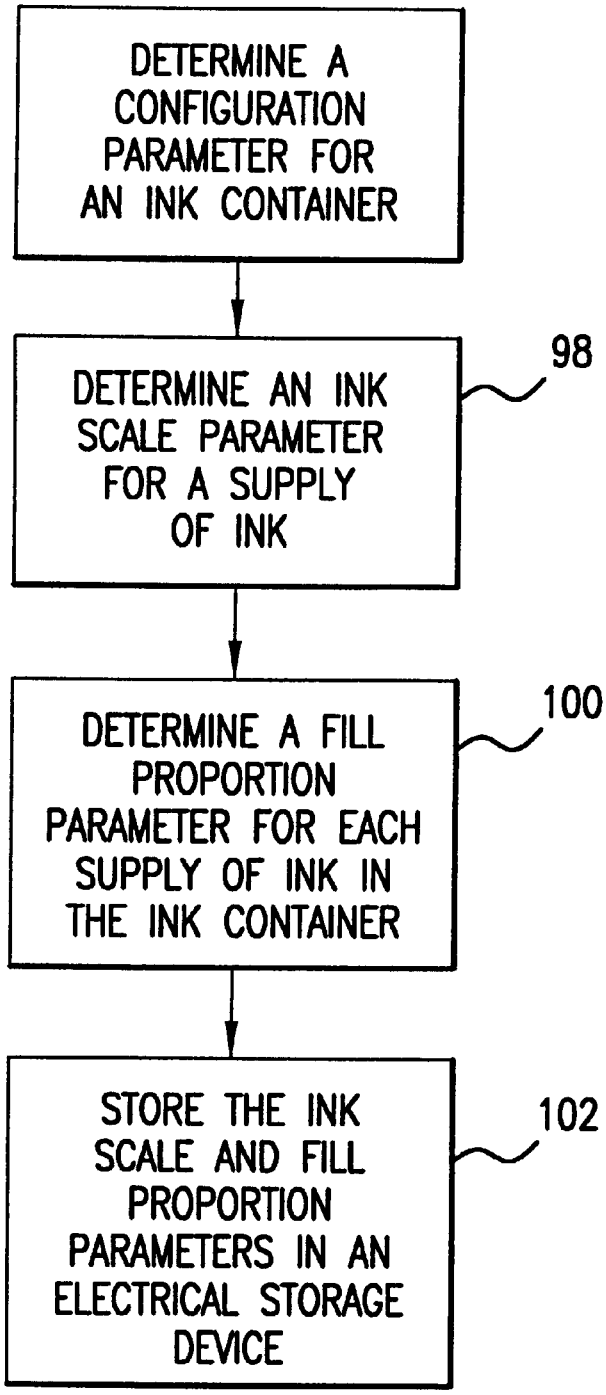
FIG. 10 depicts a flow diagram representing a method of the present invention for determining an ink volume associated with the replaceable ink container of the present invention and storing this information in an electrical storage device.

FIG. 10 depicts the technique of the present invention for storing ink volume information in the electrical storage device 80. A configuration parameter is determined for the ink container 12. The configuration parameter specifies the ink container configuration, such as, that the ink container is a monochrome ink container 12 such as shown in FIG. 7 or a tri-color ink container 12 such as shown in FIGS. 6*a*–6*d*, as a couple of examples. Alternatively, one can think of each bay 56 and 58 within the printing system 10 has a unique address. The configuration parameter then specifies the address for the bay 56, 58 that is configured to receive the ink container 12. There is only one configuration parameter for the ink container 12.

An ink scale parameter is determined for the ink volume associated with the ink container 12 as represented by step 98. The ink scale parameter identifies an ink container volume range from a plurality of ink container volume ranges. For illustration ink container volume ranges for one embodiment are shown in Table 1. The ink container scale parameter is a two-bit binary value that is used to uniquely identify each of the four ink container volume ranges. For example, the two-bit binary value of 00 represents an ink container volume range from 0–255.75 cubic centimeters (cc's). Similarly an ink container scale parameter value equal to 11, binary, represents an ink container volume range from 0–2,046 cubic centimeters. There is only one ink scale parameter for the ink container 12.

TABLE 1

| Ink Container Scale Parameter | Ink Container Volume Ranges In cc's | Resolution For 10 Bit Fill Proportion Parameter In cc's |
|---|---|---|
| 00 | 0.00 to 255.75 | 0.25 |
| 01 | 0.00 to 511.50 | 0.50 |
| 10 | 0.00 to 1023 | 1.0 |
| 11 | 0.00 to 2046 | 2.0 |

A fill proportion parameter is then determined for each supply of ink or for each separate chamber within the ink container 12 as represented by step 100. The fill proportion parameter identifies the proportion of the selected ink container volume range that represents the ink volume associated with the ink container 12. For example, the fill proportion parameter can be a 10-bit binary value. This 10-bit binary value can uniquely identify up to $2^{10}$ or 1,024 unique values. An ink volume resolution associated with the ink container 12 then varies with the ink container volume range. The resolution is represented by a maximum ink container volume in the ink container range divided by the number of the unique fill proportion parameter values. For example, for the ink container volume range 0–255.75 shown in table 1 the ink volume resolution is equal to 255.75 divided by 1,024 or approximately 0.25 cubic centimeters as shown in Table 1. Therefore, the accuracy in which the fill proportion parameter can specify the ink container volume when the ink scale parameter value selected is equal to 00 selected is 0.25 cubic centimeters. In the case where the ink container scale parameter value is 11 binary representing a much larger ink container volume range (0–2,046) then the resolution of the fill proportion parameter is 2.0 cubic centimeters. A separate fill proportion parameter is stored in the memory device 80 for each ink supply or separate chamber within the ink container 12. The ink scale and the fill proportion parameters are then stored in the electrical storage device 80 associated with the ink container 12 as represented by step 102.

Figure 11:
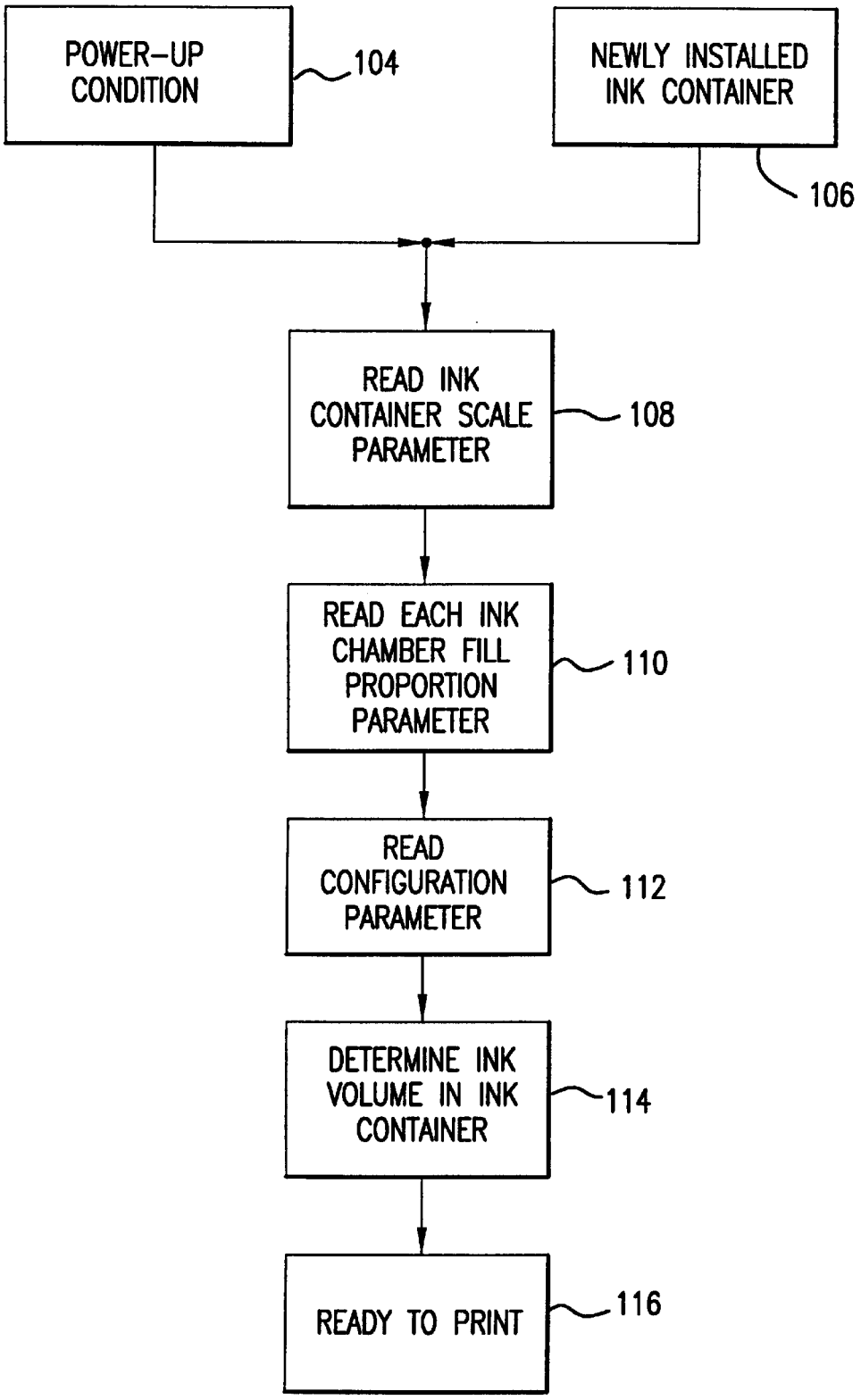
FIG. 11 depicts a flow diagram representing a method of the present invention for determining an ink volume associated with the removable ink container of the present invention.

FIG. 11 depicts a method for reading the contents of the electrical storage device 80 that has an indeterminate size prior to insertion into the printing system 10. As discussed previously, the printing system 10 is capable of accepting ink containers 12 that have varying ink container volumes. The technique of the present invention allows the particular ink volume associated with the ink container 12 to be accurately specified using minimal resources in the electrical storage device 80.

In operation, the printing system when powered up represented by step 104 or when the ink container 12 is newly installed represented by step 106 a memory read request represented by steps 108, 110 and 112 is initiated by the controller 29. This read request directs the electrical storage device 80 to provide the ink container 12 scale parameter, the ink container 12 configuration parameter and each of the fill proportion parameters for each ink chamber within the ink container 12 to the controller 29. The controller 29 interprets this information to determine the volume of ink associated with each chamber within the ink container 12 as represented by step 114. If the configuration parameter specifies a mono-chrome ink container 12 then the controller 29 will use only one fill proportion parameter. If the configuration parameter specifies a tri-color ink container 12 then the controller uses each fill proportion parameter each of which correspond to separate chambers within the ink container 12. The printing system 10 is then ready for accepting a print command from the host as represented by step 116.

Figure 12:
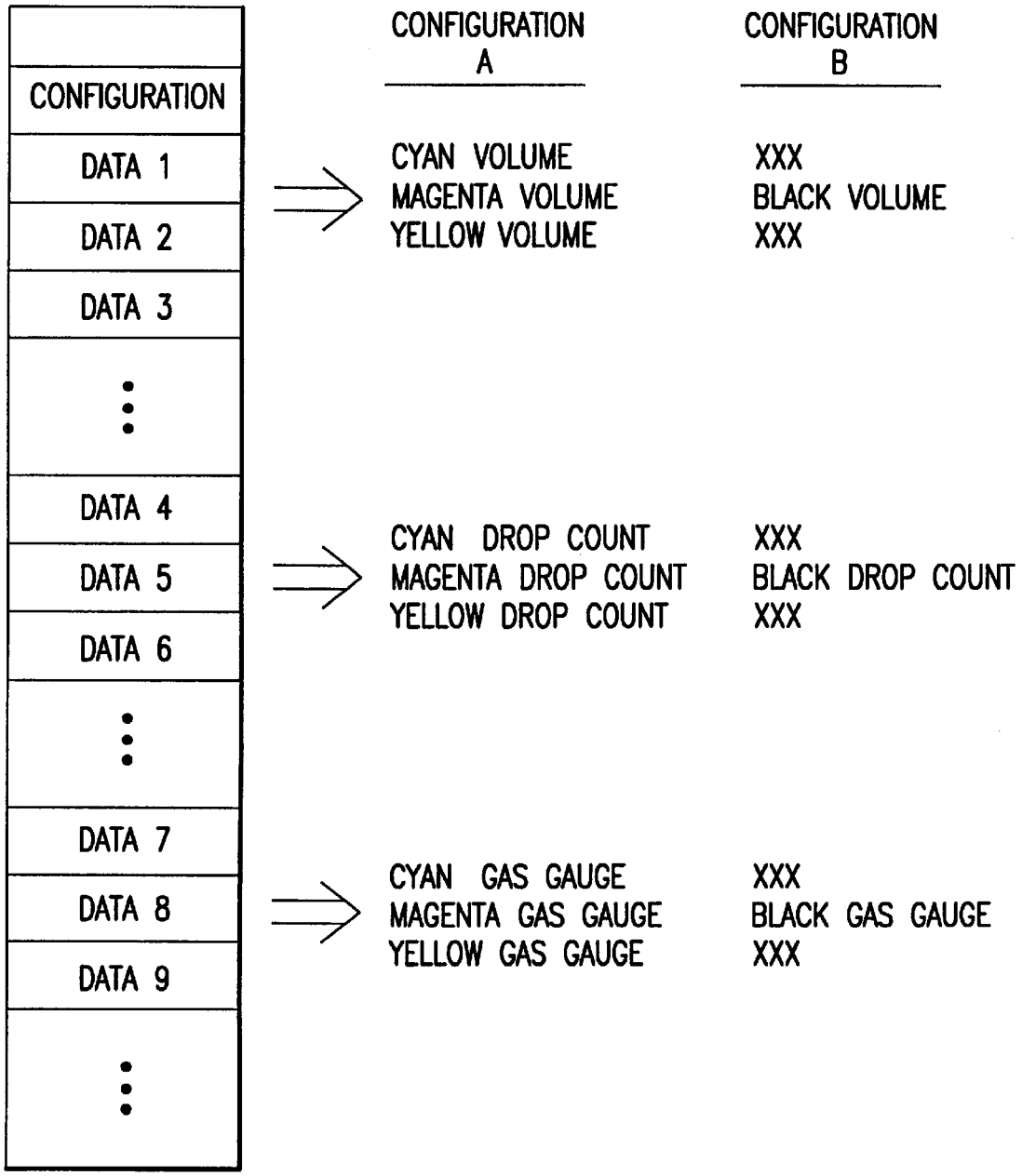
FIG. 12 represents printing system interpretation of data that is provided by a tri-color ink container and a black ink container.

FIG. 12 is one exemplary embodiment of the memory device 80 that is used in conjunction with the ink container 12 of the present invention. The memory device 80 is organized into groups of data fields, each of which is read by the controller 29 when the ink container 12 is inserted into the printing system 10. The information stored in the electrical storage device 80 includes, among other information, configuration information and a series of data fields represented by data information 1 through 9. FIG. 12 represents two different ways that the printing system 10 interprets data fields 1 through 9 depending on the configurations specified by the configuration fields. Two different configuration arrangements are shown, configuration A representing a tri-coloring container 12 and Configuration B representing a black ink container 12.

The data fields are grouped into three groupings with the first grouping represented by data 1, data 2, and data 3 representing volume information for the ink container 12. This volume information is specified using a scale parameter and a fill proportion parameter as discussed previously. The second grouping of data fields represented by data 4, data 5, and data 6 represents information relating to a current drop-count for the ink container 12. The drop-count keeps track of ink usage during the printing operation. Finally, group 3 data represented by data 7, data 8, and data 9 represents current ink volume for an amount of ink remaining in the ink container 12. This group 3 data is sometimes referred to as gas gauge information because it provides information indicative of remaining ink for the ink container 12.

Upon the insertion of the tri-coloring container 12, the controller 29 reads the information from the memory device 80 and interprets the configuration as a tri-color ink container 12 is represented by configuration A shown in FIG. 12. For configuration A, data fields 1, 2, and 3 will be interpreted by the printing system 10 as information which specifies cyan, magenta, and yellow ink volume, respectively. Therefore, the volume for each chamber within the ink container 12 is specified in a single memory device 80.

Similarly, for configuration A, the tri-color ink container 12, data fields 4, 5, and 6 are interpreted by the printing system 10 as representing current drop-count or usage information for the cyan, magenta, and yellow inks within the ink container 12. Finally, for configuration A, data fields 7, 8, and 9 in the group 3 data will be interpreted as the cyan, magenta, and yellow gas gauge information.

In contrast, upon insertion of the black ink container, the configuration information within the memory device 80 specifies that the ink container is a black ink container and therefore the printing system 10 interprets the data fields within the memory device 80 according to configuration B shown in FIG. 12. It can be seen that in configuration B, the printing system makes use of only the second data field in the first data grouping and interprets this data field as the volume of the black ink supply. The other data fields in the first grouping, data 1 and data 3 are ignored as represented by the three "X's". Similarly, in the second group of data fields the printing system 10 interprets the second group of fields as data field 5 representing the black ink drop-count and interpreting data fields 4 and data 6 information as don't care information. Finally, in the third group of data fields for configuration B, the printing system 10 interprets data field 8 information as current ink available information for the black ink with data 7 and data 9 information treated as don't care information.

Therefore, the ink container 12 contains a memory device 80 that specifies ink volume information for the container, remaining ink information for the ink container and current ink usage information for which the printing system utilizes to update the current ink usage information on the ink container 12. The technique of the present invention which makes use of a configuration information to redefine data fields on the electrical storage device 80 allows the number of fields or data information on the electrical storage device 80 to be reduced. In this manner, the electrical storage device 80 is capable of providing ink volume, current ink available and ink tracking information for each of the different chambers within the ink container 12. It can be seen, that the technique of the present invention to redefine these data fields becomes a greater savings in the size of the memory 80 as the ink container 12 has a greater number of chambers or makes use of more tracking information that is shared with the controller 29 within the printing system 10. Although the example in FIG. 12 discussed the redefining of ink volume, current ink available and ink tracking information other information fields may be redefined as well.

The technique of the present invention allows large ink volumes to be accommodated while providing improved resolution when low ink volume ranges are used. For example, for the case where the ink container scale parameter and the fill proportion parameter are combined into a single twelve bit binary value representing ink volume associated with the ink container 12 then there are $2^{12}$ unique values or 4,096 unique values to specific ink volume. Dividing the maximum ink volume the system must accommodate or 2,046 cc's by the number of unique values or 4,096 yields the ink volume resolution that is approximately 0.5 cubic centimeters. In contrast, the technique of the present invention allows a resolution of 0.25 for low ink container volume ranges thereby providing improved resolution by a factor of 2 for the low ink container volume range. This improvement in resolution at the low volume range is accomplished without requiring additional information i.e. 12 total bits of information. The improvement in resolution is greatest for the low ink container volume ranges. The resolution where resolution is most important is actually decreased slightly for the high ink container volume range. This improvement in the low ink container volume range becomes more dramatic the greater the difference in ink container volume range between the highest range and the lowest range.

Although the present invention has been described with respect to the preferred embodiment where the replaceable printing components are the printhead portion 16 mounted on the print carriage 20 and the ink container 12 mounted off of the print carriage 20 the present invention is suited for other printer configurations as well. For example, the printhead portion and the ink container portion may each be mounted on the printing carriage 20. For this configuration each of the printhead portion and the ink container portion are separately replaceable. Each of the printhead portion and the ink container includes an electrical storage portion 80 for providing information to the printing portion 18. Each ink container of a plurality of ink containers 12 may be separately replaceable or replaceable as an integrated unit. For the case where the plurality of ink containers 12 is integrated into a single replaceable printing component then only a single electrical storage portion 80 is required for this single replaceable ink container 12.

What is claimed is:

1. An ink container for providing ink to an ink-jet printer, the ink container comprising:

an electrical storage device for providing ink container parameters to the ink-jet printer, the electrical storage device containing:

a configuration parameter for specifying an ink container configuration from a plurality of ink container configurations; and an ink volume parameter for specifying an ink volume for the ink container, wherein the ink volume parameter provided to the ink-jet printer is defined by the configuration parameter.

2. The ink container of claim 1 wherein the ink volume parameter is an ink scale parameter for selecting an ink volume range from a plurality of ink volume ranges and a fill proportion parameter for specifying a fill proportion for the selected ink volume range associated with a supply of ink in the ink container.

3. The ink container of claim 2 wherein the ink scale parameter is a two bit binary value and wherein the fill proportion parameter is a 10 bit binary value specifying a proportion of the selected ink volume range.

4. The ink container of claim 2 further including a printer portion for depositing ink on media in response to control signals, the printer portion configured for receiving the ink container and determining a volume of ink associated therewith based on the ink scale parameter and the fill proportion parameter.

5. The ink container of claim 1 wherein the electrical storage device contains a plurality of ink volume parameters with each of the ink volume parameters corresponding to an ink volume associated with an ink chamber of a plurality of ink chambers within the ink container.

6. An electrical storage device for use with an ink container for providing information to an ink-jet printer, the electrical storage device comprising:

an ink scale parameter for selecting an ink volume range from a plurality of ink volume range; and a fill proportion parameter for specifying a fill proportion for the selected ink volume range.

7. The electrical storage device of claim 6 wherein the ink scale parameter is a two bit binary value and wherein the fill proportion parameter is a 10 bit binary value specifying a proportion of the selected ink volume range.

8. A method for storing ink container parameters in an electrical storage device, the electrical storage device associated with an ink container containing a volume of ink, the method comprising:

determining an ink scale parameter associated with an ink volume range for the supply of ink;

determining a fill proportion parameter for the supply of ink; and storing the ink scale parameter and ink fill parameter in the electrical storage device.

9. The method of claim 8 further including installing the ink container into an ink-jet printer establishing an electrical interconnect between the ink-jet printer and the electrical storage device.

10. The method of claim 8 further including transferring the ink scale parameter and the fill proportion parameter from the electrical storage device to the ink-jet printer, the ink-jet printer determining the volume of ink associated with the ink container based on the ink scale parameter and the fill proportion parameter.

11. A method for specifying ink volume for a system of ink containers having a plurality of ink container configurations, the method comprising:

providing a configuration parameter for specifying an ink container configuration from the plurality of ink container configurations; and providing a plurality of ink volume parameters for specifying an ink volume for the ink container, wherein the plurality of ink volume parameters are defined by the configuration parameter, and wherein the inkjet printing system determines ink volume for the ink container based on the plurality of ink volume parameters.

12. The method of claim 11 wherein the plurality of ink volume parameters include an ink scale parameter for selecting an ink volume range from a plurality of ink volume ranges and a fill proportion parameter for specifying a fill proportion for the selected ink volume range.

13. The method for claim 11 wherein the system of ink containers include ink containers having a plurality of ink chambers and wherein a single electrical storage device contains a single configuration parameter and a plurality of ink volume parameters associated with a different ink chamber of the plurality of ink chambers.

14. An inkjet printing system having a plurality of different inks for forming images on print media, the inkjet printing system comprising:

a printer portion for selectively depositing each of the plurality of inks on media in response to control signals, the printer portion configured for receiving each of the plurality of different inks;

a replaceable ink container containing the plurality of different inks, the replaceable ink container configured to provide each of the plurality of different inks to the printer portion upon insertion into the printer portion, the replaceable ink container including a single electrical storage device for providing parameters related to each of the plurality of different inks to the printer portion, the electrical storage device containing:

an ink container scale parameter for selecting an ink container volume range from a plurality of ink container volume ranges;

a plurality of fill proportion parameters with each of the plurality of fill proportion parameters for specifying a fill proportion for the selected ink volume range for the plurality of different inks associated with the ink container;

wherein the printer portion determines an ink volume associated with each of the inks associated with the ink container based on the plurality of fill proportion parameters and the selected ink volume range.

15. The ink-jet printing system of claim 14 wherein the ink container scale parameter is a two bit binary value.

16. The ink-jet printing system of claim 14 wherein the fill proportion parameter is a 10 bit binary value specifying a proportion of the selected ink volume range.

17. The ink-jet printing system of claim 14 wherein the printer portion contains the plurality of ink volume ranges with each of the plurality of ink volume ranges having a plurality of corresponding ink container volume scale parameters associated therewith.

* * * * *